United States Patent [19]

Torigai

[11] Patent Number: 4,967,700

[45] Date of Patent: Nov. 6, 1990

[54] LUBRICATING SYSTEM FOR COMBUSTION ENGINE

[75] Inventor: Katsumi Torigai, Hamamatsu, Japan

[73] Assignee: Sanshin Kogyo Kabushiki Kaisha, Hamamatsu, Japan

[21] Appl. No.: 470,877

[22] Filed: Jan. 25, 1990

[30] Foreign Application Priority Data

Jan. 27, 1989 [JP] Japan ..... 1-16465

[51] Int. Cl.[5] ..... F02B 33/04

[52] U.S. Cl. ..... 123/73 AD; 123/196 S

[58] Field of Search ..... 123/196 S, 196 R, 408, 123/328, 73 AD, 371, 325

[56] References Cited

U.S. PATENT DOCUMENTS

| | | | |
|---|---|---|---|
| 3,547,089 | 12/1970 | Pierlot | 123/408 |
| 3,554,173 | 1/1968 | Masaki | 123/328 |
| 4,369,743 | 1/1983 | Holt et al. | 123/73 AD |
| 4,480,602 | 11/1984 | Kobayashi et al. | 123/73 AD |

*Primary Examiner*—E. Rollins Cross

*Attorney, Agent, or Firm*—Ernest A. Beutler

[57] ABSTRACT

A lubricant system for an internal combustion engine of the type employed to power a vehicle that does not have a braking system of its own. In connection therewith, lubricant is supplied to the engine in response to throttle valve position. Additional lubricant is supplied under deceleration conditions when rapid closure of the throttle valve will not necessarily be accompanied by rapid reduction of engine speed so that additional lubricant is required.

22 Claims, 4 Drawing Sheets

LUBRICATING SYSTEM FOR COMBUSTION ENGINE

BACKGROUND OF THE INVENTION

This invention relates to a lubricating system for a combustion engine and more particularly to an improved system for insuring that the engine receives adequate lubricant under all running conditions.

Obviously, it is essential that an engine be provided with adequate amounts of lubricant under all running conditions. Although this ideally is desirable, there are certain types of engines and certain running characteristics wherein this may not be always possible. For example, one form of engine, the two cycle type, normally employs an arrangement for supplying metered quantities of lubricant to the engine for its lubrication during its running since the engine is not provided with a closed lubricant recirculating system. With two cycle engines, the lubricant may be delivered to the engine for its lubrication by mixing it with the fuel. Alternatively, separate lubrication systems have been proposed wherein the lubricant is delivered to the engine independently of the fuel. In either type of system, it is normally the practice to control the amount of lubricant that is delivered to the engine in response to a running characteristic such as engine speed. For instance, a conventional charge forming system employing either a carburetor or a fuel injection nozzle and in which the lubricant is delivered to the engine with the fuel will vary the amount of lubricant supplied as the throttle opening changes. Of course, when the lubricant is mixed with the fuel the amount of fuel supplied will be so varied. In many conditions, however, the actual position of the throttle valve is not fully indicative of the engine lubricant requirements.

In marine vehicles, when the engine throttle is rapidly closed, the vehicle may not readily slow since it does not have a separate braking system as a land vehicle has. Therefore, even though the throttle is closed rapidly, the engine speed will still be high. However, when the throttle position is utilized to control the amount of lubricant supplied, then the lubricant may be inadequate for lubricating the engine.

It is, therefore, a principal object of this invention to provide an improved lubricating system for an engine that will provide adequate supplies of lubricant under all running conditions.

It is a further object of this invention to provide a lubricant supply system for an engine of the type wherein the quantity of lubricant is controlled by throttle position but where additional lubricant will be supplied when the throttle position is not accurately indicative of the lubricant requirements.

It is a further object of this invention to provide an improved lubricating system for a marine propulsion device, particularly one of the two cycle type.

SUMMARY OF THE INVENTION

This invention is adapted to be embodied in a lubricating system for an internal combustion engine having throttle means for the controlling the engine speed. A lubricant system is also provided for delivering lubricant to the engine for its lubricant under the supply of a control means which controls the amount of lubricant supplied in response to the position of the throttle means. In accordance with this feature of the invention, means are provided for supplying additional lubricant to the engine than that called for by the throttle position upon rapid closure of the throttle valve.

A further feature of the invention is also adapted to be embodied in a lubricating system for an internal combustion engine of the type having a throttle, a lubricant system and control means as set forth in the preceding paragraph. In accordance with this feature of the invention, means are provided for supplying additional lubricant to the engine under conditions when the position of the throttle valve is not indicative of the actual speed of the engine.

DETAILED DESCRIPTION OF THE PREFERRED EMBODIMENTS OF THE INVENTION

Figure 1:
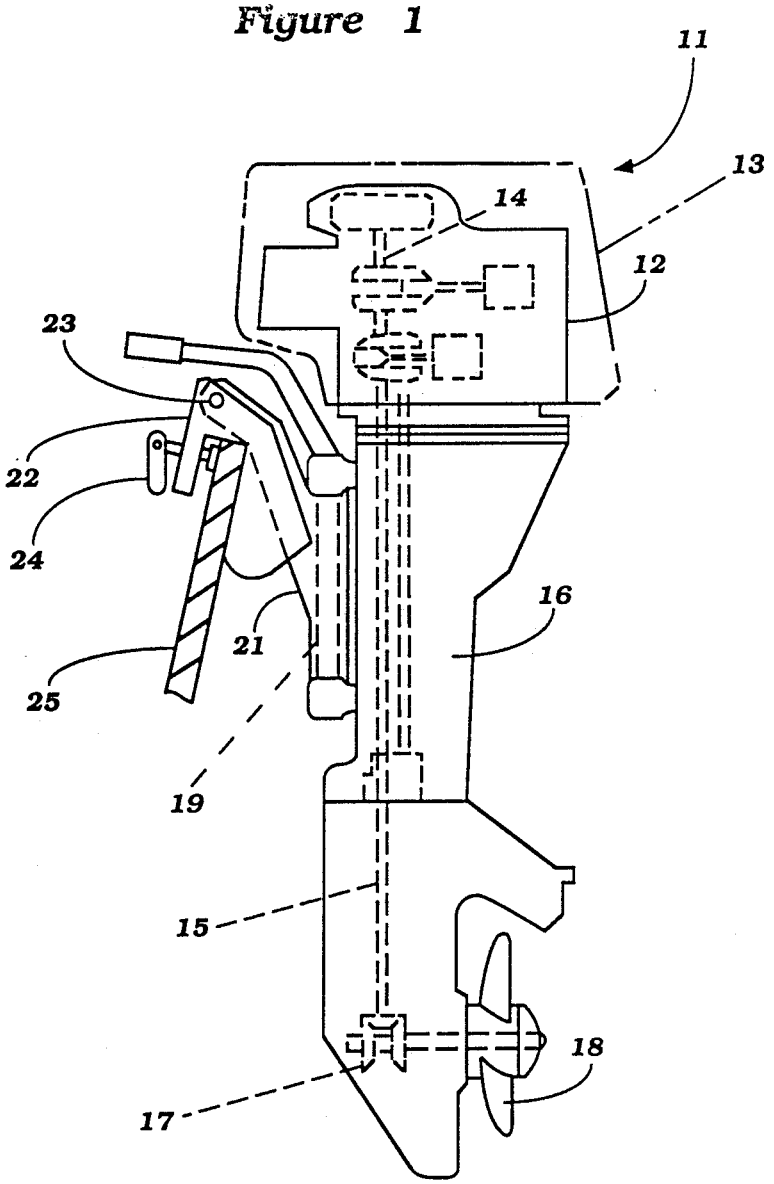
FIG. 1 is a side elevational view of an outboard motor constructed in accordance with an embodiment of the invention, with portions shown in phantom and other portions broken away.

Referring first to FIG. 1, an outboard motor constructed in accordance with an embodiment of the invention is identified generally by the reference numeral The invention is described in conjunction with, but not limited to, such an application. However, an outboard motor is a typical environment in which the invention may be practiced because an outboard motor is used to power a vehicle that does not have a separate braking system and also because outboard motors normally employ two cycle internal combustion engines. It is to be understood that the invention can be utilized in conjunction with other types of vehicles and in connection with engines other than two cycle engines.

The outboard motor 11 includes a power head that is comprised of an internal combustion engine 12 and a surrounding protective cowling, shown in phantom at 13. The engine 12 is, in the illustrated embodiment, of the two cylinder in line type. It is to be understood, however, that the invention may be utilized in conjunction with engines having other cylinder numbers, other configurations or, in fact, engines other than reciprocating engines.

The engine 12 is supported so that its crankshaft 14 rotates about a vertically extending axis, as is normal practice with outboard motors, and drives a drive shaft 15 that depends into and is journaled within a drive shaft housing 16. The lower end of the drive shaft 15 drives a conventional forward, neutral, reverse transmission 17 for driving a propeller 18 in selected forward and reverse directions.

The outboard motor 11 further includes a steering shaft 19 that is affixed to the drive shaft housing and which is journaled within a swivel bracket 21 for steering of the outboard motor 11. The swivel bracket 21 is connected to a clamping bracket 22 for pivotal movement about a horizontally extending axis by means of a pivot pin 23. This pivotal movement permits tilt and trim adjustment of the outboard motor as is well known in this art. A clamping device 24 is provided on the clamping bracket 22 for connection to a transom 25 of an associated watercraft as is also well known.

Figure 2:
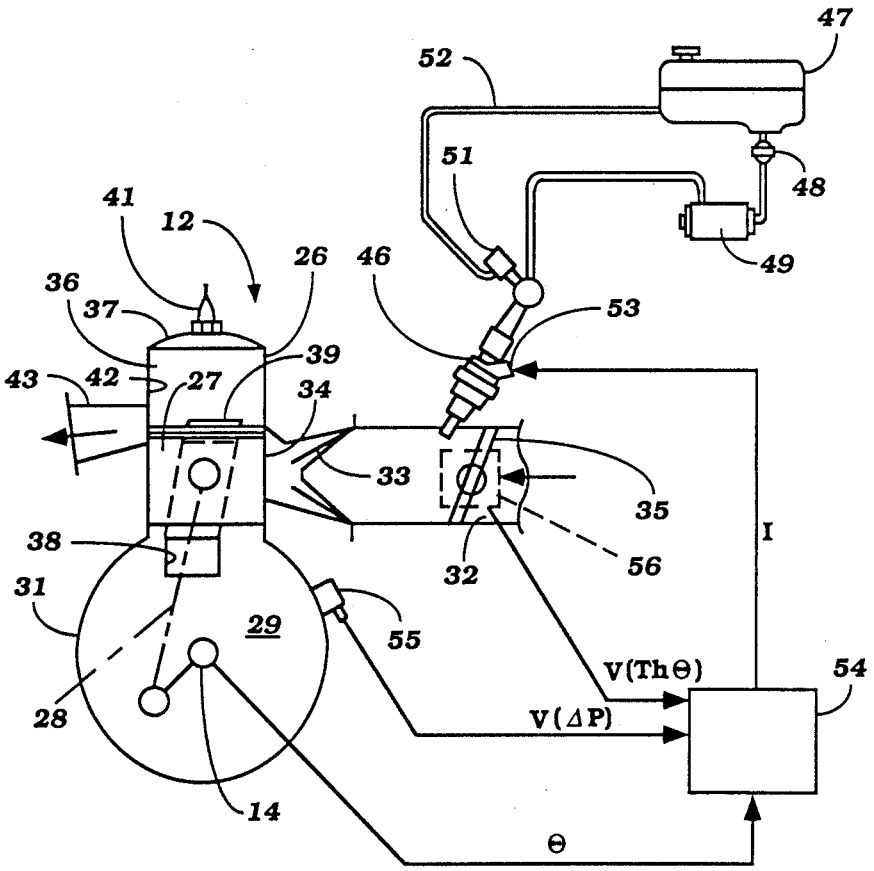
FIG. 2 is a partially schematic view of the engine showing the components thereof and specifically the fuel and lubrication system therefor.

Referring now primarily to FIG. 2, the engine 12 will be described in conjunction with its fuel and lubricating system. The invention has been depicted in conjunction with only one cylinder 26 of the engine but it will be obviously known by those skilled in the art how to practice the invention in conjunction with multiple cylinder engines. A piston 27 reciprocates in the cylinder 26 and is connected by means of a connecting rod 28 to drive the crankshaft 14. The crankshaft 14 is journaled within a crankcase chamber 29 formed by the crankcase 31 of the engine.

A fuel/air charge is delivered to the crankcase chamber 29 from an induction system that includes an intake passage 32 and which has a reed type check valve disposed between and an intake port 34 which communicates with the crankcase chamber 29 when the piston is not at its bottom dead center position. A throttle valve 35 is positioned within the intake passage 32 for controlling the air flow therethrough and, accordingly, the speed of the engine 12.

The charge of fuel and air which is admitted to the crankcase chamber 29 is transmitted to a combustion chamber 36 formed above the head of the piston 27 and the cylinder head 37 through a transfer or scavenge passage 38 and one or more ports 39 which open through the wall of the cylinder 26. This charge is then fired by a spark plug 41 and is discharged through an exhaust port 42 and exhaust manifold 43.

The engine is provided with a fuel injection system of the type generally shown in United States Letters Pat. No. 4,446,833, issued May 8, 1984, entitled "Fuel Injection Apparatus For An Internal Combustion Engine" and assigned in part to the assignee hereof. Basically this injection system includes a fuel injection nozzle 44 that sprays into the induction passage 32 downstream of the throttle valve 35. Fuel and mixed lubricant is supplied to the fuel injection nozzle 46 from a remotely positioned fuel lubricant tank 47 through a fuel strainer 48 and high pressure fuel pump 49. A pressure relief valve 51 controls the fuel pressure supplied to the injection nozzle 46 by bypassing excess fuel and lubricant back to the fuel tank 47 through a return conduit 52.

The injection valve 46 has the timing and duration of fuel injected controlled by means of a control valve 53 which is, in turn, operated by a central control 54. The central control 54 receives an input signal indicative of crankcase pressure VOP from a crankcase pressure sensor 55. This pressure is, as noted in aforenoted Pat. No. 4,446,833 indicative of the maximum pressure in the crankcase and thus affords an accurate indication of the desired timing. In addition, a crankcase angle position sensor (not shown) provides a crankshaft angle signal $\theta$ to the control 54.

In addition to these controls, there is provided a throttle position sensor 56 which is associated with the throttle valve 35 and which provides a signal to the control 54 that is indicative of throttle valve position.

Basically the system operates so as to provide fuel and mixed lubricant to the engine in response to the speed as indicated by the position of the throttle sensor 56. Since the engine 12 is associated with a watercraft which has no braking system as such, when the engine throttle valve 35 is rapidly closed, the engine speed will not reduce. If the amount if fuel and, of course, lubricant supplied to the engine is reduced in response to this change in position of the throttle valve 35, there could be inadequate lubrication. Therefore, a system which will be described by reference, for example to FIGS. 3 and 4, is provided for supplying additional fuel to the engine under such conditions.

Before referring in detail to this figure, the logic under which this system operates is that normally, unless there is a rapid change in throttle valve position, the amount of fuel supplied will be determined by the control 54 in accordance with a premapped program depending upon throttle valve position, crankcase pressure $\Delta P$ and crank angle 0. When sudden throttle closure is sensed, an additional duration of fuel injection will be provided so as to insure that adequate lubricant will be supplied to the engine.

Figure 3:
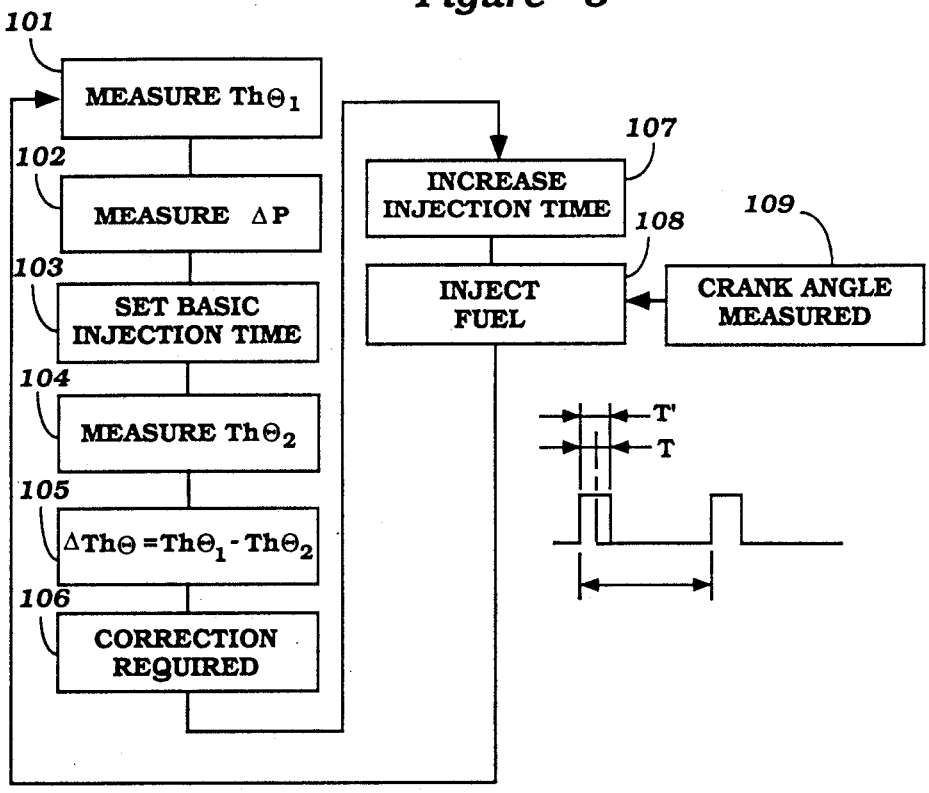
FIG. 3 is a block diagram showing one method by which the operation may be practiced.
Figure 4:
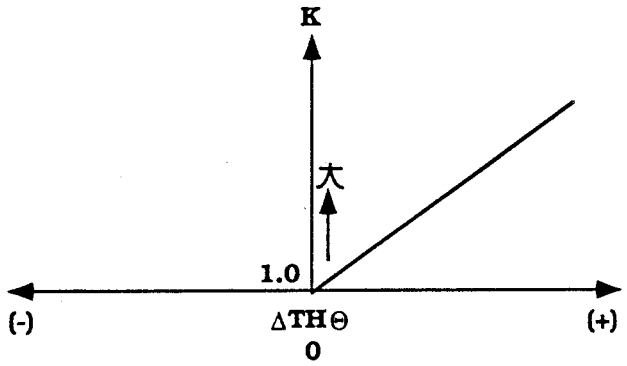
FIG. 4 is a graphic view showing the lubricant adjustment amount of fuel in connection with this embodiment.

Referring now to FIG. 3, the program is initiated at a step 101 wherein the throttle valve position Th01 at a given point in time is measured. Then the program moves to the step 102 wherein the crankcase pressure $\Delta P$ is also measured. The program then moves to the step 103 wherein the control 54 sets the basic injection time duration dependent primarily upon the basic throttle position. Then a basic injection signal is outputted at the step 104 so as to create a pulse with T so as to inject the necessary amount of fuel. After a predetermined time period lapse between the measurement of Th$\theta$1, the program at the step 104 again measures the throttle valve position Th02. Then at the step 105 the program determines the change in throttle valve position $\Delta$Th$\theta$ by subtracting from Th$\theta$1 the value of Th$\theta$2.

The control 54 then moves to the step 106 to determine if correction is required and if so, the magnitude of the correction. This correction is determined by the correction curve shown in FIG. 4 wherein an additional time period K for fuel injection is determined in response to the magnitude of the rate of change of the throttle valve position. The slope of this curve may be determined experimentally in response to the engine parameters.

If it is determined that the correction is required, the program then moves to the step 107 so as to increase the fuel injection time. Fuel injection is then initiated at the step 108 dependent upon both the time and in response to the crankshaft angle as sensed by the block 109. The program then moves to the step 101 for t he next engine cycle.

It should be readily apparent that this embodiment operates so as to provide additional fuel injection by extending the time of duration of fuel injection where the throttle valve is being closed more rapidly than under normal running conditions. Hence the engine speed will not be truly indicated by the throttle valve position.

Figure 5:
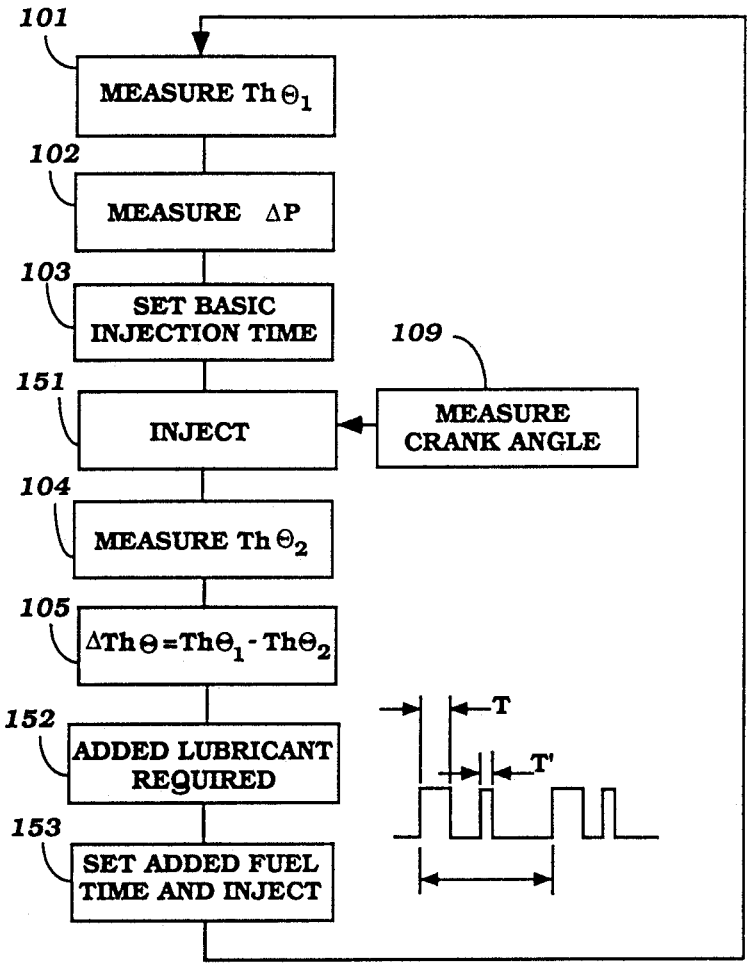
FIG. 5 is a block diagram, in part similar to FIG. 4, showing another embodiment of the invention.
Figure 6:
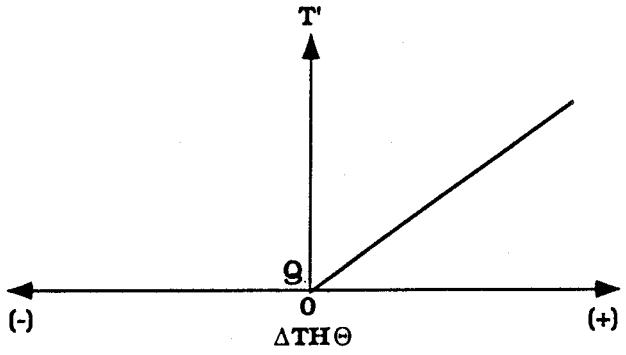
FIG. 6 is a graphic view showing the additional lubricant supplement provided with this embodiment.

FIGS. 5 and 6 show another embodiment wherein the additional amount of lubricant is supplied by providing an additional pulse to the injector nozzle 46 of a different duration depending upon the conditions of deceleration. Such an arrangement may have some advantages in that the lubricant will not be supplied at a time when the spark plug is being fired and some adverse running conditions may be avoided in this way.

Referring now to this embodiment and specifically to the block diagram of FIG. 5, again at the initiation step 101 the device measures the throttle angle from the sensor 56. The system then moves again to the step 102 so as to measure crankcase pressure ΔP. Again, at the step 103 the program then determines the basic injection timing in accordance with a premapped curve. In this embodiment, however, the program then moves to the step 151 wherein injection is commenced by injecting the amount of fuel set at the step 103 in response to the desired crank angle as measured at the step 109.

At some time interval after the initial throttle position has been at the step 105 there is taken a further reading of throttle valve position at a step 104. Then at the step 105 it is again determined whether the change in throttle position is significant enough to indicate that throttle position will not be truly indicative of engine speed. The program then moves to the correction step 152 where it is determined if additional lubricant is required. If so, the amount of correction required in accordance with the curve shown in FIG. 6 is determined at the step 103 and the injection nozzle is again activated by the controller 54 to inject additional fuel and lubricant for a time T'.

The curve of FIG. 6 is generated and mapped into the program of the control 54 where the additional time T' is required is determined by the measurement in the change of position of the throttle valve in view of time for the reasoning as aforenoted.

As should be readily apparent, therefore, the two embodiments of the invention illustrated and described are highly effective in insuring that adequate lubricant will be supplied to the engine during such times when the throttle valve position is not truly indicative of the engine speed. Although the invention has been described in conjunction with fuel injection systems, it can also be utilized in conjunction with carburetor systems wherein an enrichment system is activated in response to the sensed condition of rapid throttle closing. Also, the invention can be utilized in conjunction with separate lubrication systems wherein the lubricant is not mixed with the fuel. However, the invention has particular utility in arrangements wherein the fuel and lubricant are mixed.

It is to be understood that the foregoing descriptions are of the preferred embodiment of the invention. Various changes and modifications may be made without departing from the spirit and scope of the invention, as defined by the appended claims.

I claim:

1. A lubrication system for an internal combustion engine having throttle means for controlling engine speed, a lubrication system for delivering lubricant to said engine for its lubrication, control means for controlling the amount of lubricant supplied to the engine in response to the position of said throttle means, and means for supplying additional lubricant to said engine from that called for in the throttle position in response to rapid closure of the throttle valve.

2. A lubrication system as set forth in claim 1 wherein additional lubricant is supplied by extending the duration of the lubricant delivery.

3. A lubrication system as set forth in claim 1 wherein additional lubricant is supplied by supplying an additional amount of lubricant at a different time period.

4. A lubrication system as set forth in claim 1 wherein the lubricant is mixed with the fuel.

5. A lubrication system as set forth in claim 4 wherein additional lubricant is supplied by supplying additional fuel lubricant mixture

6. A lubrication system as set forth in claim 5 wherein additional lubricant is supplied by extending the duration of the lubricant delivery.

7. A lubrication system as set forth in claim 5 wherein additional lubricant is supplied by supplying an additional amount of lubricant at a different time period.

8. A lubrication system as set forth in claim 5 wherein the fuel and lubricant is supplied by a fuel injector.

9. A lubrication system as set forth in claim 8 wherein additional lubricant is supplied by extending the duration of the lubricant delivery.

10. A lubrication system as set forth in claim 8 wherein additional lubricant is supplied by supplying an additional amount of lubricant at a different time period.

11. A lubrication system as set forth in claim 1 wherein the engine powers a vehicle having no braking of its own whereby reduction of throttle valve position is not necessarily accompanied by an immediate engine speed decrease.

12. A lubrication system for an internal combustion engine having throttle means for controlling engine speed, a lubrication system for delivering lubricant to said engine for its lubrication, control means for controlling the amount of lubricant supplied to the engine in response to the position of said throttle means, and means for supplying additional lubricant to the engine under conditions when the throttle valve position is not indicative of engine speed.

13. A lubrication system as set forth in claim 12 wherein additional lubricant is supplied by extending the duration of the lubricant delivery.

14. A lubrication system as set forth in claim 12 wherein additional lubricant is supplied by supplying an additional amount of lubricant at a different time period.

15. A lubrication system as set forth in claim 12 wherein the lubricant is mixed with the fuel.

16. A lubrication system as set forth in claim 15 wherein additional lubricant is supplied by supplying additional fuel lubricant mixture.

17. A lubrication system as set forth in claim 16 wherein additional lubricant is supplied by extending the duration of the lubricant delivery.

18. A lubrication system as set forth in claim 16 wherein additional lubricant is supplied by supplying an additional amount of lubricant at a different time period.

19. A lubrication system as set forth in claim 16 wherein the fuel and lubricant is supplied by a fuel injector.

20. A lubrication system as set forth in claim 19 wherein additional lubricant is supplied by extending the duration of the lubricant delivery.

21. A lubrication system as set forth in claim 19 wherein additional lubricant is supplied by supplying an additional amount of lubricant at a different time period.

22. A lubrication system as set forth in claim 12 wherein the engine powers a vehicle having no braking of its own whereby reduction of throttle valve position is not necessarily accompanied by an immediate engine speed decrease.

* * * * *